US012426735B2

(12) United States Patent
Wang

(10) Patent No.: US 12,426,735 B2
(45) Date of Patent: Sep. 30, 2025

(54) COMBINED CARPET

(71) Applicant: Xuelei Wang, Tianjin (CN)

(72) Inventor: Xuelei Wang, Tianjin (CN)

( * ) Notice: Subject to any disclaimer, the term of this patent is extended or adjusted under 35 U.S.C. 154(b) by 0 days.

(21) Appl. No.: 18/611,757

(22) Filed: Mar. 21, 2024

(65) Prior Publication Data

US 2024/0225332 A1 Jul. 11, 2024

Related U.S. Application Data

(63) Continuation-in-part of application No. 18/104,757, filed on Feb. 1, 2023, now abandoned.

(51) Int. Cl.
*A47G 27/02* (2006.01)

(52) U.S. Cl.
CPC ..... *A47G 27/0281* (2013.01); *A47G 27/0268* (2013.01)

(58) Field of Classification Search
CPC ..... D06N 7/0073; D06N 2203/042; D06N 7/0071; D06N 7/0065; D06N 7/0081; D06N 7/0076; D06N 7/0068; D06N 2201/02; D06N 2201/0263; D06N 7/0086; D06N 2203/068; D06N 2201/0254; D06N 2203/061; D06N 2203/048; D06N 2209/08; D06N 2209/1628; D06N 2211/066; D06N 7/0036; D06N 2203/041; D06N 2201/082; D06N 2205/04; D06N 2209/067; D06N 7/0078; D06N 2203/045; D06N 2203/065; D06N 2205/06; D06N 2205/18; D06N 2201/06; D06N 2213/065; D06N 7/0063; D06N 2205/023; D06N 2205/106; D06N 2209/105; D06N 7/00; D06N 2201/042; D06N 2205/20; D06N 2209/083; D06N 2203/08; D06N 7/0089; D06N 2207/123; D06N 2205/026; D06N 2205/10; D06N 2209/0807; D06N 2209/106; D06N 2209/1685; D06N 2213/02; D06N 2213/068; D06N 2209/025; D06N 7/0084; D06N 2209/045; D06N 2209/065; D06N 2209/0823; D06N 2209/12; D06N 2209/128; D06N 2209/16; D06N 2209/1671; D06N 2201/10;

(Continued)

(56) References Cited

U.S. PATENT DOCUMENTS

2005/0051264 A1 3/2005 Allison et al.
2009/0239021 A1 9/2009 Wise (Continued)

*Primary Examiner* — Lynda Salvatore
(74) *Attorney, Agent, or Firm* — Hemisphere Law, PLLC; Zhigang Ma

(57) ABSTRACT

The present disclosure provides a combined carpet. The combined carpet includes an upper carpet body and a lower carpet body. The upper carpet body that includes a first anti-skidding layer. The lower carpet body that is paved between the upper carpet and an object surface, wherein a size of the lower carpet body is less than that of the upper carpet body so as to be completely covered by the upper carpet body, and the lower carpet body includes a first flexible fabric layer. When the upper carpet body is paved above the lower carpet body, the first anti-skidding layer resists to the first flexible fabric layer, such that the upper carpet body and the lower carpet body realize a relative rest through a static friction force, to form a detachable combination.

17 Claims, 11 Drawing Sheets

(58) Field of Classification Search
CPC ..... D06N 2203/02; D06N 2205/02; D06N 2209/046; D06N 2209/165; D06N 2211/06; D06N 2211/263; D06N 3/042; D06N 2201/0245; D06N 2203/047; D06N 2205/045; D06N 2207/04; D06N 2209/041; D06N 2209/141; D06N 2209/142; D06N 2209/147; D06N 2211/267; D06N 2201/0236; D06N 2201/045; D06N 2203/022; D06N 2205/14; D06N 2209/1621; D06N 2209/1678; D06N 2209/1692; D06N 2211/18; D06N 2211/266; D06N 2213/03; D06N 2213/04; D06N 2213/063; D06N 2213/066; D06N 3/0006; D06N 3/0009; D06N 3/0011; D06N 3/004; D06N 3/0063; D06N 3/0088; D06N 3/04; D06N 3/10; D06N 3/106; D06N 3/12; D06N 3/128; D06N 2201/12; D06N 2203/026; D06N 2203/066; D06N 2207/08; D06N 2209/0861; D06N 2209/0869; D06N 2209/103; D06N 2211/26; D06N 2213/06; D06N 3/14; D06N 7/0026; D06N 7/0031; D06N 7/0057; D06N 7/0094; B32B 2471/02; B32B 27/12; B32B 7/12; B32B 27/32; B32B 2307/102; B32B 5/18; B32B 5/022; B32B 5/26; B32B 2262/0276; B32B 2471/00; B32B 5/024; B32B 2262/0253; B32B 27/065; B32B 5/245; B32B 2266/0278; B32B 2605/08; B32B 5/02; B32B 2262/101; B32B 27/36; B32B 37/06; B32B 2255/02; B32B 2307/56; B32B 27/40; B32B 5/24; B32B 2037/243; B32B 2255/26; B32B 2307/734; B32B 2419/04; B32B 27/08; B32B 27/18; B32B 2262/0261; B32B 2250/02; B32B 27/20; B32B 27/304; B32B 27/34; B32B 37/12; B32B 37/1284; B32B 2305/20; B32B 2307/558; B32B 2605/003; B32B 5/06; B32B 2307/546; B32B 2307/72; B32B 27/306; B32B 33/00; B32B 37/10; B32B 37/1207; B32B 38/0004; B32B 7/02; B32B 2260/025; B32B 2266/025; B32B 2307/554; B32B 2310/0862
See application file for complete search history.

(56) References Cited

U.S. PATENT DOCUMENTS

2016/0129300 A1* 5/2016 Moore ..... B32B 7/05 428/35.5
2016/0326676 A1 11/2016 Baudet

* cited by examiner

COMBINED CARPET

CROSS-REFERENCE TO RELATED APPLICATIONS

This application is a Continuation-in-Part of the U.S. application Ser. No. 18/104,757 filed on Feb. 1, 2023, and entitled "Combined carpet,", the entire disclosures of which are incorporated herein by reference.

TECHNICAL FIELD

The present disclosure relates to the carpet field, and in particular to a combined carpet.

BACKGROUND

With the diverse development of the social culture, a carpet is more widely used in human production and life. For better shock absorption and sound insulation effects as well as a comfortable foot feeling, the carpet usually adopts a heavier fabric, however the fabric is heavier and difficultly put into a washing machine, making the cleaning difficult, and moreover when the carpet has a great area, the cleaning is more difficult, which brings a poor cleaning experience to users.

At present, in order to solve the problem that the carpet is heavier and not easy to clean, the carpet on the market is mostly woven into a thinner carpet, but the thinner carpet has poor shock absorption and sound insulation effects, leading to a poor texture and a poor comfort level.

SUMMARY

To overcome the deficiencies in the existing technology, the present disclosure provides a combined carpet that may be used separately or used in combination, and is easy to clean.

The technical solution adopted by the present disclosure to solve the technical problem is as follows.

A combined carpet includes:

an upper carpet body that includes a first anti-skidding layer;

a lower carpet body that is paved between the upper carpet and an object surface, wherein a size of the lower carpet body is less than that of the upper carpet body so as to be completely covered by the upper carpet body, and the lower carpet body includes a first flexible fabric layer; and when the upper carpet body is paved above the lower carpet body, the first anti-skidding layer resists to the first flexible fabric layer, such that the upper carpet body and the lower carpet body realize a relative rest through a static friction force, to form a detachable combination.

Compared with the prior art, the combined carpet provided by the present disclosure adopts the first anti-skidding layer to resist to the first flexible fabric layer, a friction force existing therebetween is used to make the first anti-skidding layer and the first flexible fabric layer keep a relative rest; and when human or pets walk on the carpet, a force in a horizontal direction is less than the static friction force therebetween, such that the first anti-skidding layer and the first flexible fabric layer can still keep the relative rest to avoid a separation thereof. Meanwhile, the first anti-skidding layer and the first flexible fabric layer may be detachably combined such that the upper carpet body and the lower carpet body can be used in combination or used separately according to demands; when combined use is adopted, the thickness of the carpet may be increased effectively, such that the combined carpet has better shock absorption, sound insulation effects and a high comfortable level; when separate use is required in some scenarios, the upper carpet body or the lower carpet body may be used separately, such that the combined carpet has diversified using scenarios, and the commonality thereof is improved. In addition, since the size of the lower carpet body is less than that of the upper carpet body, the lower carpet body can be completely covered by the upper carpet body, is always between the upper carpet body and the object surface such as the floor, and can keep clean and tidy, and therefore frequent cleaning for the lower carpet body is not required; and when the carpet needs to be cleaned, the frequently contacted upper carpet body needs to be cleaned and tidied only, and at this time the upper carpet body is directly separated from the lower carpet body for cleaning, to keep the combined carpet clean and tidy.

Further, a thickness of the upper carpet body is less than or equal to that of the lower carpet body. The upper carpet body is designed to be thinner than the lower carpet body, such that the upper carpet body can be easily cleaned during cleaning and washed by using a washing machine, which is convenient and quick; and the thicker lower carpet body can increase the thickness of the combined carpet, making the whole combined carpet more comfortable. The combined use of the upper carpet body and the lower carpet body is not only convenient to clean, but also can meet the demands of shock absorption and sound insulation, with a relatively high using comfort level, thereby improving the using effect of the product.

Further, the upper carpet body further includes a first buffer layer and a second flexible fabric layer, the first buffer layer is arranged on one side of the first anti-skidding layer that is away from the lower carpet body, the second flexible fabric layer is arranged on one side of the first buffer layer that is away from the first anti-skidding layer, and the first anti-skidding layer includes a rubber layer, on which anti-skidding lines are arranged. The first buffer layer and the second flexible fabric layer are arranged on the upper carpet body, such that the upper carpet body may also be paved on the object surface separately for use and has certain shock absorption and sound insulation effects; in addition, adopting the rubber layer with the anti-skidding lines may enable the upper carpet body to have a better anti-skidding property and after the first buffer layer is arranged, the comfort level of the combined carpet may be improved further.

Further, the first anti-skidding layer further includes a first fabric layer, the first fabric layer is arranged on one side of the rubber layer that is away from the second flexible fabric layer, and adhered to the rubber layer by adopting a hot-pressing technology; and the first buffer layer is a needle-punched non-woven fabric, and the second flexible fabric layer includes a polyester material. Hot-pressing the first fabric layer on the rubber layer may slow down the aging speed of the rubber layer, thus improving the service life of the rubber layer, and the friction force of the first anti-skidding layer may also be increased, thus improving the anti-skidding ability of the first anti-skidding layer, such that the upper carpet body and the lower carpet body can have better anti-skidding property whether used separately or in combination, and the anti-skidding property of the combined carpet is improved.

Further, the upper carpet body further includes a first knitted covered edge that is disposed along a side of the upper carpet body, and edges of the second flexible fabric layer, the first buffer layer and the first anti-skidding layer are covered. Through the above structure setting, the original texture of the upper carpet body may be retained while improving the side abrasive resistance of the upper carpet body, so that the edge of the upper carpet body is not easy to loose, and the service life of the upper carpet body may be further improved.

Further, the lower carpet body further includes a second anti-skidding layer, and the second anti-skidding layer is arranged on one side of the first flexible fabric layer that is away from the upper carpet body, and the second anti-skidding layer is used for resisting to the object surface. The second anti-skidding layer is set such that the lower carpet body can keep still and avoid sliding when paved on the object surface such as the floor, thus improving the using experience of the product.

Further, the lower carpet body further includes a second buffer layer that is arranged between the first flexible fabric layer and the second anti-skidding layer. specifically the second buffer layer is thicker than the first buffer layer. Setting the second buffer layer may increase the thickness of the lower carpet body and improve the comfort level and using experience of the product, and the second buffer layer is set to be thicker, such that the whole combined carpet is thicker, thus improving the shock absorption and sound insulation effects as well as the comfort level of the product.

Further, the second buffer layer is a needle-punched non-woven fabric, the second anti-skidding layer includes silica gel, and the silica gel is adhered to a surface of one side of the second buffer layer that is away from the first flexible fabric layer, and the first flexible fabric layer includes a polyester material.

The silica gel is spot-molded on the second buffer layer by adopting the spot-molding process, which not only increases the friction force of the product, but also improves the anti-skidding ability of the product and at the same time enables the product to be more beautiful, and in addition, the silica gel is non-toxic and tasteless, more environmentally friendly with a soft touch and a better using experience.

Further, the second anti-skidding layer includes a second fabric layer and a hot-melt adhesive layer, the second fabric layer is compounded on one side of the second buffer layer that is away from the first flexible fabric layer, and the hot-melt adhesive layer is located on a surface of one side of the second fabric layer that is away from the second buffer layer.

Coating the hot-melt adhesive on the second fabric layer is not only non-toxic and environmentally friendly, has a better touch and a certain viscosity, such that the lower carpet body has a certain viscosity with the object surface such as the floor when playing an anti-skidding role, and the lower carpet body can also be coated on the object surface in a sticking form, to improve the anti-skidding ability of the carpet and reduce a possibility that the combined carpet slides during use.

Further, the second fabric layer includes a plurality of first woven yarns and a plurality of second woven yarns; and the plurality of first woven yarns and the plurality of second woven yarns are crossly arranged, so as to form the second fabric layer.

Further, the lower carpet body further includes a second knitted covered edge that is disposed along a side of the lower carpet body, and edges of the first flexible fabric layer, the second buffer layer and the second anti-skidding layer are covered.

Further, a percentage value of an area of the lower carpet body and an area of the upper carpet body ranges from 50% to 95%.

Further, the percentage value of the area of the lower carpet body and the area of the upper carpet body ranges from 55% to 90%.

Further, the percentage value of the area of the lower carpet body and the area of the upper carpet body ranges from 55% to 80%. The upper carpet body can completely cover the lower carpet body by limiting the area ratio of the lower carpet body to the upper carpet body, after being combined, the upper carpet body and the lower carpet body have a maximized coincidence area, and at the same time the problems of edge warping, displacement and difficult paving occurred to the edge position of the upper carpet body can also be avoided, such that the combined carpet has less problem and can keep a higher comfort level during use.

Further, both the upper carpet body and the lower carpet body are a rectangular shape and have a length, width and thickness, and a ratio value of a length of the lower carpet body and a length of the upper carpet body ranges from 60% to 100%.

Further, the ratio value of the length of the lower carpet body and the length of the upper carpet body ranges from 75% to 95%.

Further, a ratio value of a width of the lower carpet body and a width of the upper carpet body ranges from 100% to 55%.

Further, the ratio value of the width of the lower carpet body and the width of the upper carpet body ranges from 90% to 60%. The upper carpet body may be ensured to completely cover the lower carpet body by limiting the lengths and widths of the upper carpet body and the lower carpet body, after combination, at least part of the long side or wide side of the upper carpet body can be paved on the object surface, thus avoiding the problems of edge warping, displacement and difficult paving occurred to the edge position of the upper carpet body, such that the combined carpet has less problem and can keep a higher comfort level during use.

Further, a surface of one side of the first anti-skidding layer that faces to the first flexible fabric layer is also provided with an alignment mark, the alignment mark is used for aligning a long side or a short side or a corner of the lower carpet body, such that the lower carpet body is located below a preset position of the upper carpet body when the upper carpet body is paved above the lower carpet body. The lower carpet body may be aligned with the upper carpet body conveniently during paving by setting the alignment mark, such that the combined paving is more convenient.

Further, the combined carpet further includes glue that is adhered to four corners of the first anti-skidding layer, such that the upper carpet body is adhered to the object surface. The upper carpet body can be more stably adhered to the object surface by setting the glue, to further ensure the stability that the combined carpet is paved on the object surface when avoiding the relative sliding of the upper carpet body and the lower carpet body, to improve the anti-skidding ability.

BRIEF DESCRIPTION OF THE DRAWINGS

In order to explain the technical solutions of the embodiments of the present disclosure more clearly, the following will briefly introduce the accompanying drawings used in the embodiments. The drawings in the following description are only some embodiments of the present disclosure. Those of ordinary skill in the art can obtain other drawings based on these drawings without creative work.

The present disclosure is further described below in detail in combination with the accompanying drawings and embodiments.

DETAILED DESCRIPTION OF THE EMBODIMENTS

Figure 1:
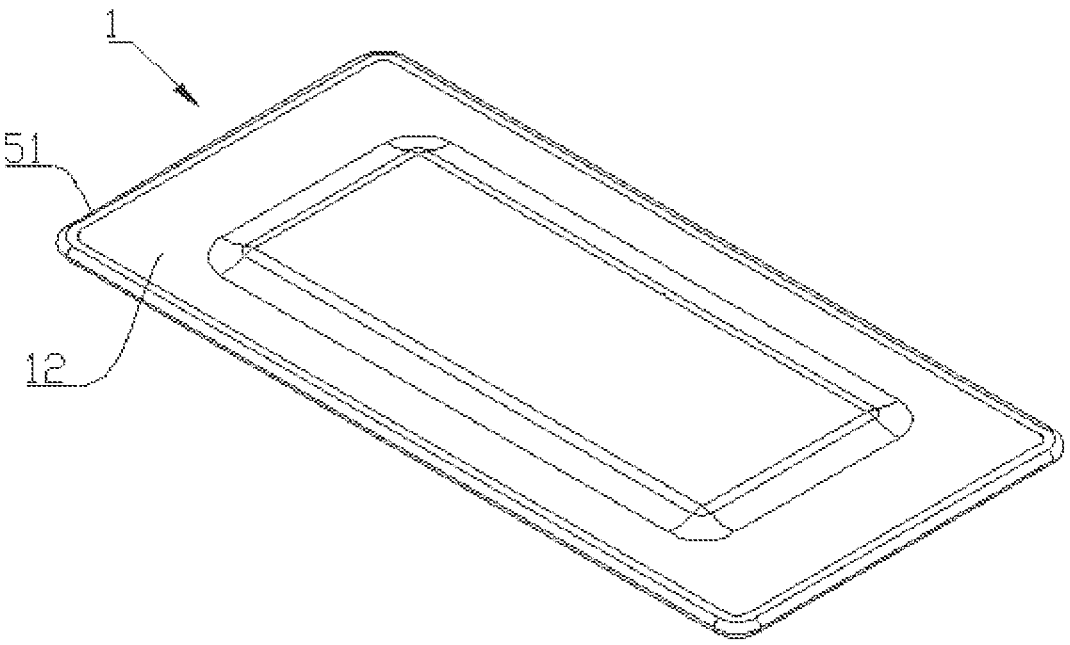
FIG. 1 is a solid diagram of a combined carpet in the present disclosure.
Figure 2:
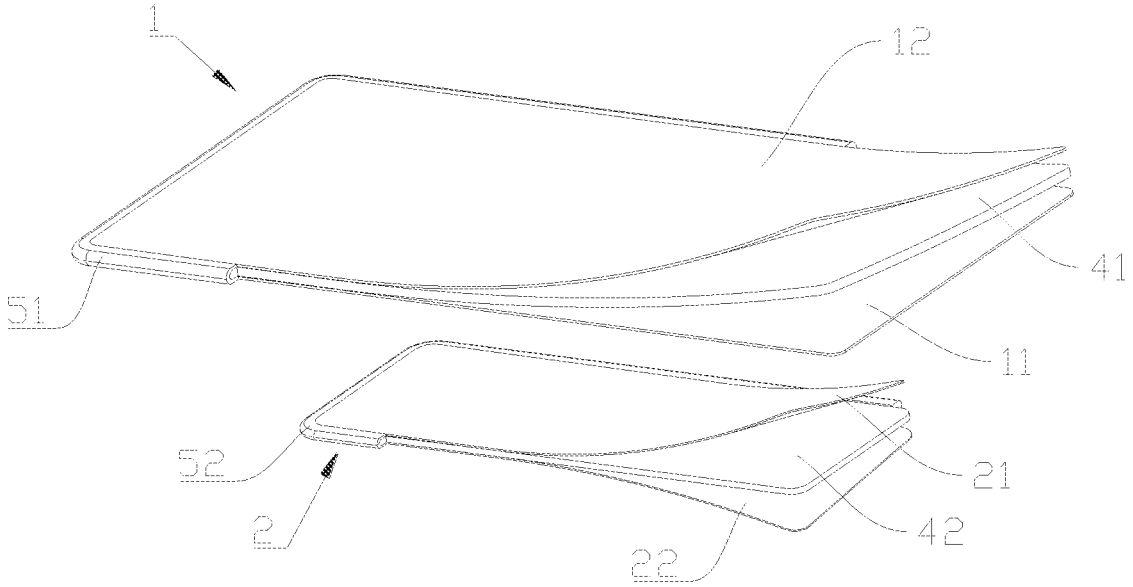
FIG. 2 is an exploded diagram of a combined carpet in the present disclosure.

Referring to FIG. 1 and FIG. 2, the present disclosure provides a combined carpet, including an upper carpet body 1 and a lower carpet body 2; the upper carpet body 1 includes a first anti-skidding layer 11, a first flexible fabric layer 21 is arranged at a top of the lower carpet body 2, a size of the lower carpet body 2 is less than that of the upper carpet body 1 such that the lower carpet body 2 can be completely covered by the upper carpet body 1, and the upper carpet body 1 is covered on the first flexible fabric layer 21 of the lower carpet body 2 by the first anti-skidding layer 11 thereof, such that upper carpet body 1 and the lower carpet body 2 realize a relative rest through a static friction force, to form a detachable combination.

Specifically, in the present disclosure, the upper carpet body 1 covering the lower carpet body 2 completely means that the lower carpet body 2 is paved on a horizontal floor when the combined carpet is paved on an object surface such as a floor, and a horizontal projection of the lower carpet body 2 on the floor is completely covered by that of the upper carpet body 1 on the floor when the upper carpet body 1 is paved on the lower carpet body 2.

Through the foregoing structure setting, the combined carpet provided by the present disclosure adopts the first anti-skidding layer 11 to resist to the first flexible fabric layer 21, a friction force existing therebetween is used to make the first anti-skidding layer 11 and the first flexible fabric layer 21 keep a relative rest; and when human or pets walk on the carpet, a force in a horizontal direction is less than the static friction force therebetween, such that the first anti-skidding layer 11 and the first flexible fabric layer 21 can still keep the relative rest to avoid a separation thereof. Meanwhile, the first anti-skidding layer 11 and the first flexible fabric layer 21 may be detachably combined such that the upper carpet body 1 and the lower carpet body 2 can be used in combination or used separately according to demands; when combined use is adopted, the thickness of the carpet may be increased effectively, such that the combined carpet has better shock absorption, sound insulation effects and a high comfortable level; when separate use is required in some scenarios, the upper carpet body 1 or the lower carpet body 2 may be used separately, such that the combined carpet has diversified using scenarios, and the commonality thereof is improved. In addition, since the size of the lower carpet body 2 is less than that of the upper carpet body 1, the lower carpet body 2 can be completely covered by the upper carpet body 1, is always between the upper carpet body 1 and the object surface such as the floor, and can keep clean and tidy, and therefore frequent cleaning for the lower carpet body 2 is not required; and when the carpet needs to be cleaned, the frequently contacted upper carpet body 1 needs to be cleaned and tidied only, and at this time the upper carpet body 1 is directly separated from the lower carpet body 2 for cleaning, to keep the combined carpet clean and tidy. Since the size of the lower carpet body 2 is less than that of the upper carpet body 1, the part that does not resist to the first flexible fabric layer 21 in the first anti-skidding layer 11 of the upper carpet body 1 may also be in contact with the object surface such as the floor and also improve the friction between the upper carpet body 1 and the ground, to prevent the upper carpet body 1 skidding from the floor, thereby improving the using effect of the carpet.

Further, since the upper carpet body 1 may be mutually separated from the lower carpet body 2, both the upper carpet body 1 and the lower carpet body 2 may be used as the carpet separately, so as to effectively improve the commonality of the carpet provided by the present disclosure, and users may select the upper carpet body and the lower carpet body according to different using scenarios. For example, when placing space is small, it may consider using the lower carpet body 2, and since the first flexible fabric layer 21 is disposed at the top of the lower carpet body 2, the lower carpet body 2 has a better appearance, a better touch, a better decoration effect and a capability of reducing noise, so as to ensure the experience of using the lower carpet body 2 separately. When the ground is wet, it may consider using the upper carpet body 1, and since the first anti-skidding layer 11 is disposed at the bottom of the upper carpet body 1, the upper carpet body 1 has a better anti-skidding effect, so as to ensure the experience of using the upper carpet body 1 separately.

In this embodiment, both the upper carpet body 1 and the lower carpet body 2 are the product with a solid structure, and have a certain thickness. Specifically, a thickness of the upper carpet body 1 is less than or equal to that of the lower carpet body 2. In this embodiment, to make the upper carpet body 1 be cleaned more easily, the thickness of the upper carpet body 1 is less than that of the lower carpet body 2. In the present disclosure, the thickness of the upper carpet body 1 and the lower carpet body 2 is the total sum of the thickness of various layers of the carpet body, and when the the surface of the carpet body has the fluff, the height of the fluff is not calculated in the thickness. In another embodiment, the fluff on the surface of the carpet body may be set highly, such that the product has a better experience. The upper carpet body 1 is designed to be thinner than the lower carpet body 2, such that the upper carpet body 1 can be easily cleaned during cleaning; and the thicker lower carpet body 2 can increase the thickness of the combined carpet, making the whole combined carpet more comfortable.

Please refer to FIG. 2 to FIG. 5, in this embodiment, the upper carpet body 1 further includes a first buffer layer 41 and a second flexible fabric layer 12, the first buffer layer 41 is arranged on one side of the first anti-skidding layer 11 that is away from the lower carpet body 2, the second flexible fabric layer 12 is arranged on one side of the first buffer layer 41 that is away from the first anti-skidding layer 11, and the first anti-skidding layer 11 includes a rubber layer, on which anti-skidding lines are arranged. Specifically, the rubber layer is made of thermoplastic vulcanizate, which is also named as thermoplastic rubber or thermoplastic rubber (TPR) or thermoplastic vulcanizate (TPV). The first buffer layer 41 and the second flexible fabric layer 12 are arranged on the upper carpet body 1, such that the upper carpet body 1 may also be paved on the object surface separately for use and has certain shock absorption and sound insulation effects; in addition, adopting the rubber layer with the anti-skidding lines may enable the upper carpet body 1 to have a better anti-skidding property, a certain elasticity and waterproofness, to effectively improve the anti-skidding property of the first anti-skidding layer 11 and increase the using scenarios; and after the first buffer layer 41 is arranged, the comfort level of the combined carpet may be improved further. The upper carpet body 1 in the present disclosure may be used in a zone with a great human traffic or low sound insulation and shock absorption requirements, such as a kitchen, a living room, a dining room, an utility room, below furniture and a lobby of a commercial office building, and the upper carpet body 1 is thinner and soft, may be folded for carrying, and thus the upper carpet body 1 may be temporarily used for a picnic and a camp.

In this embodiment, the first anti-skidding layer 11 further includes a first fabric layer, the first fabric layer is arranged on one side of the rubber layer that is away from the second flexible fabric layer 12, and adhered to the rubber layer by adopting a hot-pressing technology. Specifically, the first fabric layer is cotton cloth that is directly adhered to the rubber layer in a hot-press form. Hot-pressing the first fabric layer on the rubber layer may slow down the aging speed of the rubber layer, thus improving the service life of the rubber layer, and the friction force of the first anti-skidding layer 11 may also be increased, thus improving the anti-skidding ability of the first anti-skidding layer 11, such that the upper carpet body and the lower carpet body can have better anti-skidding property whether used separately or in combination, and the anti-skidding property of the combined carpet is improved. By setting the second flexible fabric layer 12, the upper carpet body 1 is softer, has a better touch, a better decoration effect and a capability of reducing noise, such that the upper carpet body 1 also has certain shock absorption and sound insulation effects and a higher comfort level when used separately, and has a better effect when used in combination with the lower carpet body 2.

The lower carpet body 2 further includes a second anti-skidding layer 22, the second anti-skidding layer 22 is arranged on one side of the first flexible fabric layer 21 that is away from the upper carpet body 1, and the second anti-skidding layer 22 is used for resisting to the object surface. The second anti-skidding layer 22 is set such that the lower carpet body 2 has a better anti-skidding property whether used separately or in combination with the upper carpet body 1, thus improving the using experience of the product.

Specifically, the lower carpet body 2 further includes a second buffer layer 42 that is arranged between the first flexible fabric layer 21 and the second anti-skidding layer 22, and specifically the second buffer layer 42 is thicker than the first buffer layer 41. Setting the second buffer layer 42 may increase the thickness of the lower carpet body 2 and improve the comfort level and using experience of the product, and the second buffer layer 42 is set to be thicker, such that the whole combined carpet is thicker, thus improving the shock absorption and sound insulation effects as well as the comfort level of the product. The lower carpet body 2 in the present disclosure may be used in a place with a small human traffic or high sound insulation and shock absorption requirements, such as a loft, a bedroom floor and stairs, to keep a quiet and comfortable environment.

Figure 6:
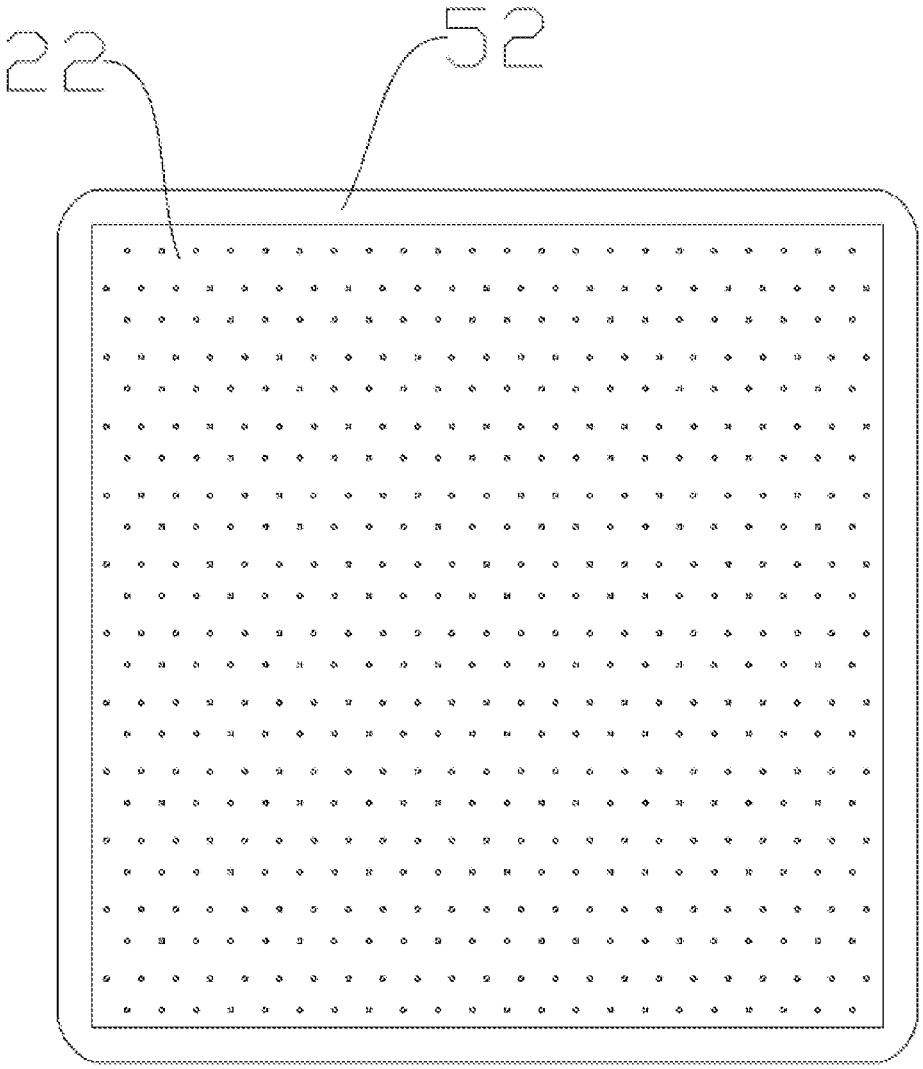
FIG. 6 is a diagram of a second anti-skidding layer of a lower carpet body in one embodiment of the present disclosure.

Please refer to FIG. 6, in one embodiment of the present disclosure, the second anti-skidding layer 22 includes silica gel, and the silica gel is adhered to a surface of one side of the second buffer layer 42 that is away from the first flexible fabric layer 21 by adopting a spot-molding process. The silica gel is spot-molded on the second buffer layer 42 by adopting the spot-molding process, which not only increases the friction force of the product, but also improves the anti-skidding ability of the product and at the same time enables the product to be more beautiful, and in addition, the silica gel is non-toxic and tasteless, more environmentally friendly with a soft touch and a better using experience. In another embodiment, plastics may also be adopted to replace the silica gel to reduce the cost.

Figure 7:
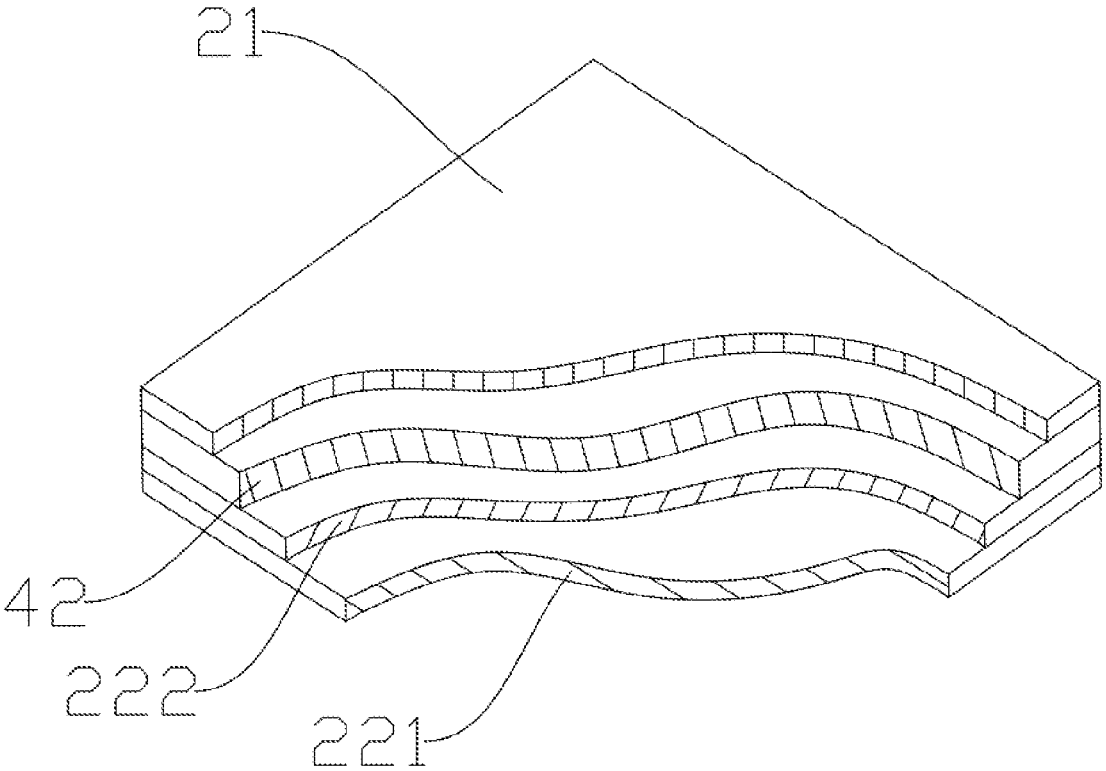
FIG. 7 is a structure diagram of a second anti-skidding layer of a lower carpet body in another embodiment of the present disclosure.

Please refer to FIG. 7, in another embodiment of the present disclosure, the second anti-skidding layer 22 includes a second fabric layer 222 and a hot-melt adhesive layer 221, the second fabric layer 222 is compounded on one side of the second buffer layer 42 that is away from the first flexible fabric layer 21, and the hot-melt adhesive layer 221 is located on a surface of one side of the second fabric layer 222 that is away from the second buffer layer 42. The coating mode may be a spraying mode, through which the hot-melt adhesive can be coated on the second fabric layer 222, or a scraper may also be adopted to scrape the hot-melt adhesive on the second fabric layer 222, a roll coating process may also be adopted to brush the hot-melt adhesive on a roller for coating, or a dip coating process, a brush coating process and the like as long as the hot-melt adhesive can be coated on the second fabric layer 222. Coating the hot-melt adhesive on the second fabric layer 222 is not only non-toxic and environmentally friendly, has a better touch and a certain viscosity, such that the lower carpet body 2 has a certain viscosity with the object surface, and the lower carpet body 2 can also be coated on the object surface in a sticking form, to improve the anti-skidding ability of the carpet.

Figure 8:
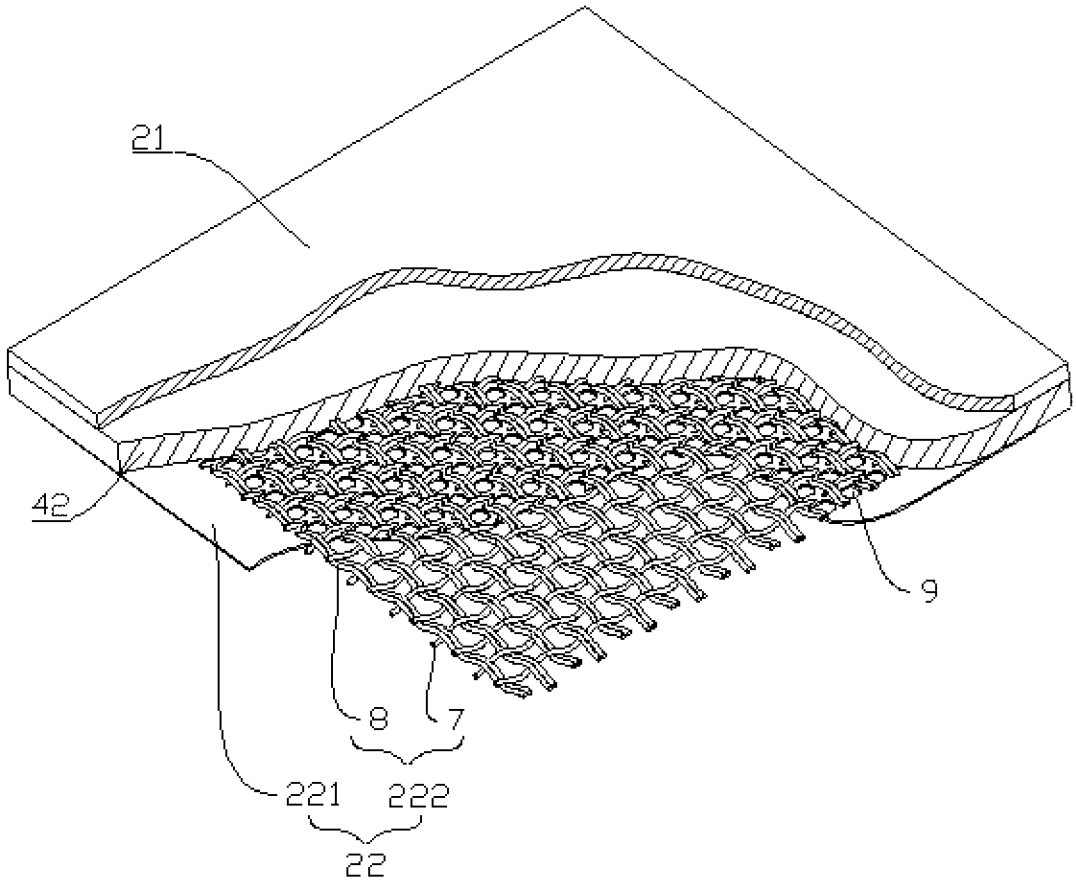
FIG. 8 is a structure diagram of a lower carpet body in the present disclosure.

Specifically, please refer to FIG. 8, the second fabric layer 222 includes a plurality of first woven yarns 7 and a plurality of second woven yarns 8; the plurality of first woven yarns 7 and the plurality of second woven yarns 8 are crossly arranged, so as to form the second fabric layer 222; and the hot-melt adhesive is attached to the first woven yarns 7 and the second woven yarns 8, and of course some hot-melt adhesive will enter the first woven yarns 7 and the second woven yarns 8. Since the first woven yarns 7 and the second woven yarns 8 form the second fabric layer 222 in a weaving form, weaving holes 9 will be formed between the first woven yarns 7 and the second woven yarns 8, and when the hot-melt adhesive is coated on the second fabric layer 222, the weaving holes 9 will not be plugged, such that the lower carpet body 2 has an air permeability while the anti-skidding property is improved, thereby effectively improving the using effect of the carpet.

The first woven yarns 7 and the second woven yarns 8 are all cotton yarns, which have better air permeability, moisture absorption and more stable attachment of the thermoplastic rubber. Of course, the first woven yarns and the second woven yarns may also be fibrilia yarns, silk yarns, chemical fiber yarns, etc. In another embodiment, a method that is the same as that of the second fabric layer 222 may be adopted to obtain the first fabric layer.

In this embodiment, both the first buffer layer 41 and the second buffer layer 42 are needle-punched non-woven fabrics, and both the first flexible fabric layer 21 and the second flexible fabric layer 12 include a polyester material. Specifically, the first flexible fabric layer 21 and the second flexible fabric layer 12 may be chenille layers woven by the polyester, a velvet surface of the chenille is full and soft and has good drapability, good water absorption, static resistance, antibacterial property and other effects, so as to effectively improve the using effect of the carpet.

In another embodiment, the first flexible fabric layer 21 and the second flexible fabric layer 12 may be made of different materials that may be a chenille layer, a wool layer, a chinlon layer, a polyester layer or cotton and other flexible material layers; to enable the product to have the waterproof function, the material may also be a hydrophobic material layer, or the flexible material and the hydrophobic material are mixed and woven in a certain ratio, and a limitation is not made in this application. In another embodiment, the first buffer layer 41 and the second buffer layer 42 may also be made of a chemical fiber, a coir fiber, pure cotton and other flexible materials as long as achieving the buffering, shock absorption, reducing noise and improving the comfort level.

Figure 3:
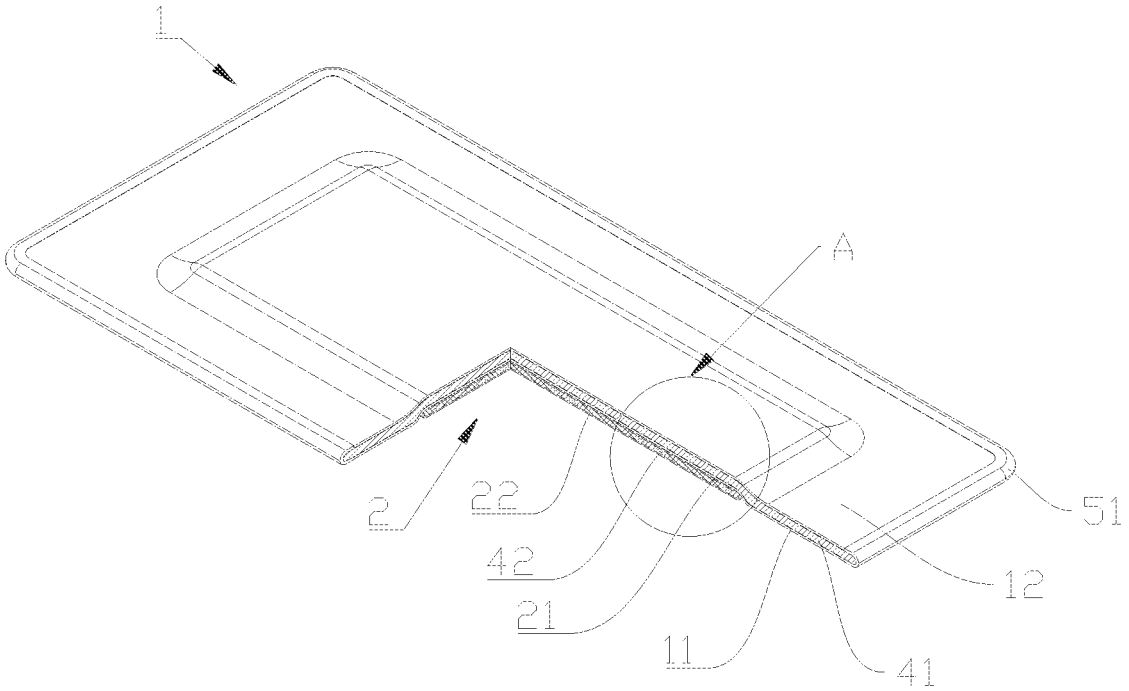
FIG. 3 is a solid section cutting view of a combined carpet in the present disclosure.

Please refer to FIG. 3, in this embodiment, the upper carpet body 1 further includes a first knitted covered edge 51 that is disposed along a side of the upper carpet body 1, and edges of the second flexible fabric layer 12, the first buffer layer 41 and the first anti-skidding layer 11 are covered. In another embodiment, the first knitted covered edge 51 may also cover the edges of the second flexible fabric layer 12 and the first buffer layer 41 only. Through the above structure setting, the original texture of the upper carpet body 1 may be retained while improving the side abrasive resistance of the upper carpet body 1, so that the edge of the upper carpet body 1 is not easy to loose, and the service life of the upper carpet body 1 may be further improved.

Figure 4:
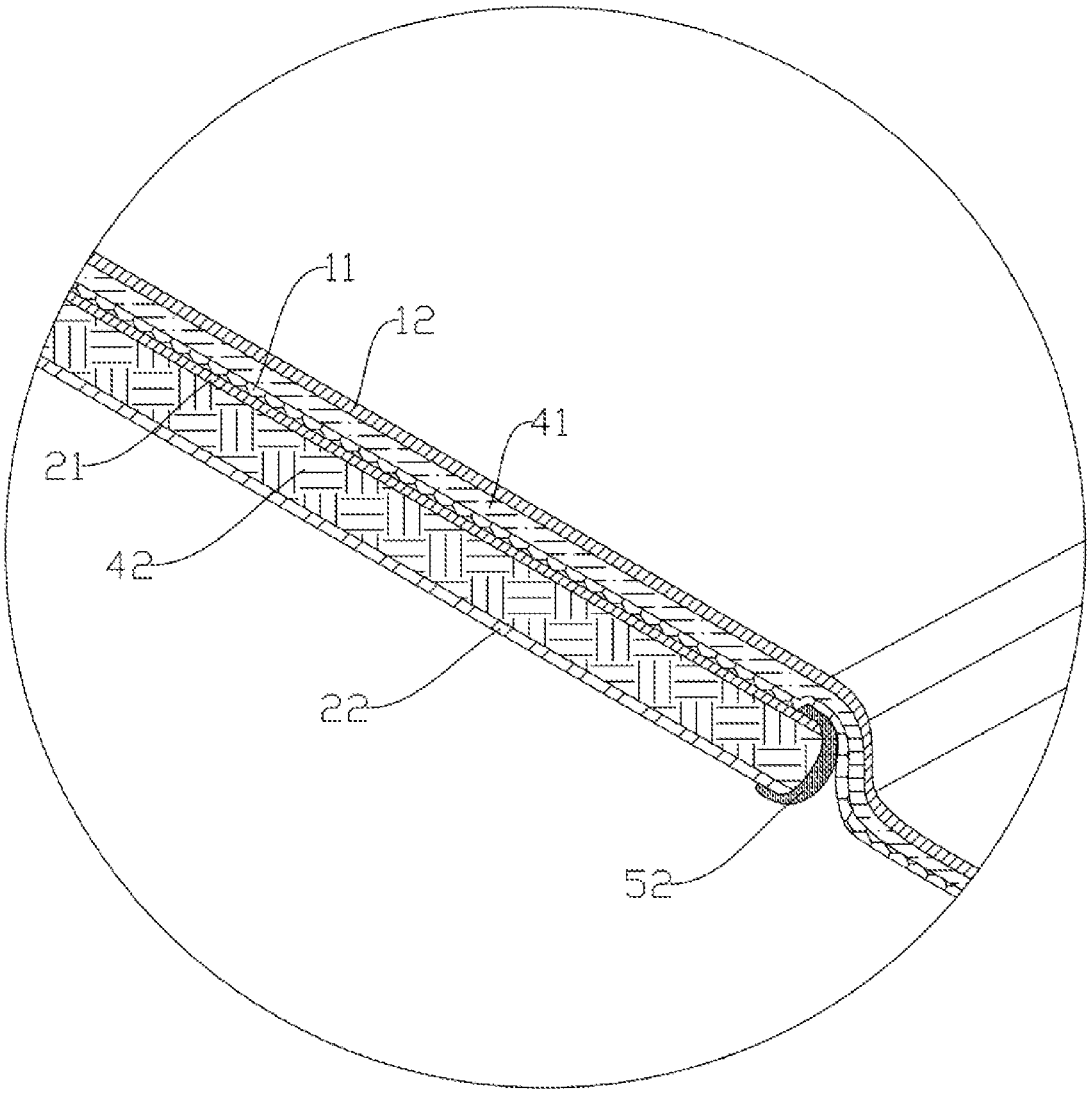
FIG. 4 is a local enlarged diagram of a part A in FIG. 3.
Figure 5:
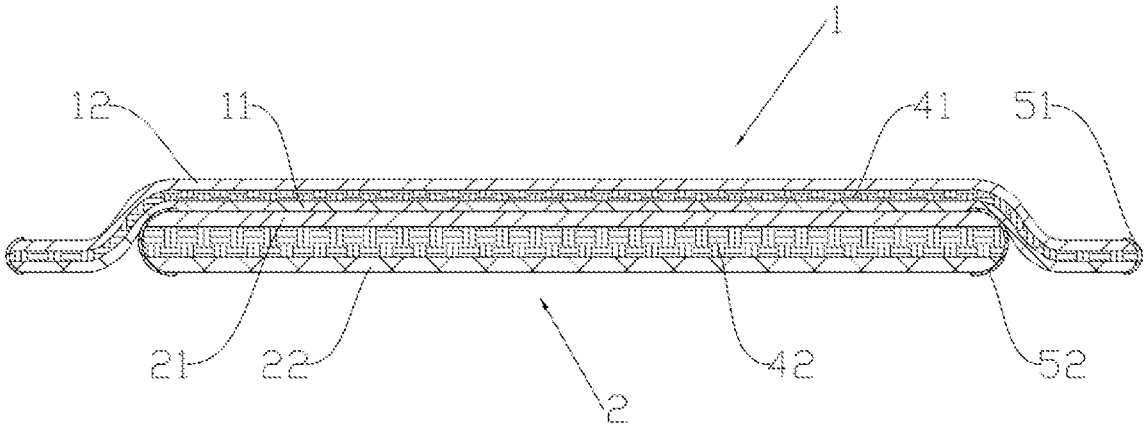
FIG. 5 is a section cutting diagram of a combined carpet used in combination.

Please refer to FIG. 4, the lower carpet body 2 further includes a second knitted covered edge 52 that is disposed along a side of the upper carpet body 2, and edges of the second flexible fabric layer 21, the first buffer layer 42 and the first anti-skidding layer 22 are covered. Through the above structure setting, the original texture of the lower carpet body 2 may be retained while improving the side abrasive resistance of the lower carpet body 2, so that the edge of the lower carpet body 2 is not easy to loose, and the service life of the lower carpet body 2 may be further improved.

Figure 9:
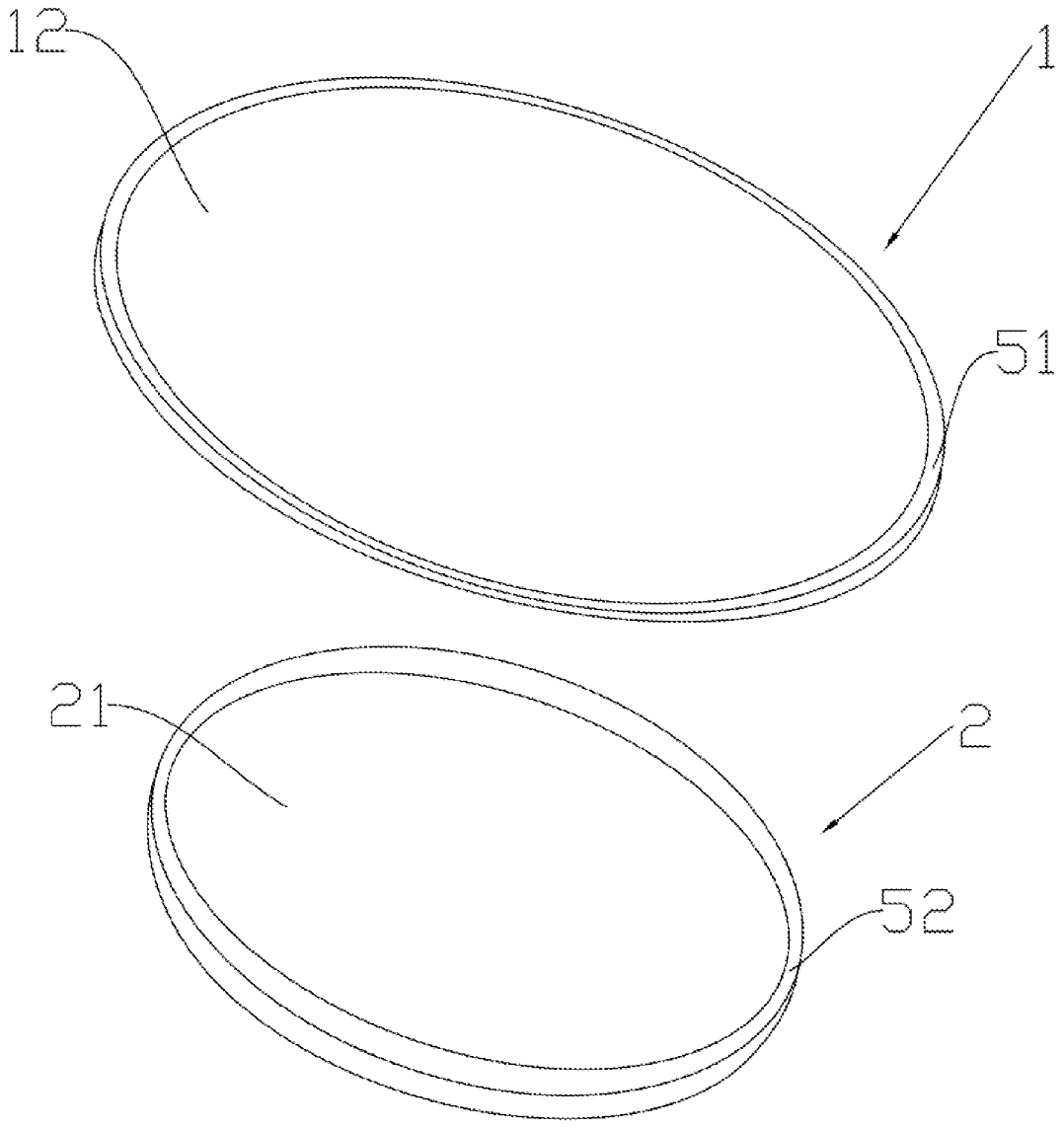
FIG. 9 is a diagram of a round combined carpet in the present disclosure.

In the embodiment of the present disclosure, the upper carpet body 1 and the lower carpet body 2 may be round, rectangular, polygonal and different polygonal combinations, as shown in FIG. 9, which shows a diagram of a round combined carpet. To enable the combined carpet to have a better comfort level as well as calculate and cut the carpet size conveniently during production, a limitation to the areas and sizes of the upper carpet body 1 and the lower carpet body 2 is made in the present disclosure. Specifically, a percentage value of an area of the lower carpet body 2 and an area of the upper carpet body 1 ranges from 50% to 95%. Specifically, the percentage value of the area of the lower carpet body 2 and the area of the upper carpet body 1 may be 50%, 55%, 60%, 65%, 70%, 75%, 80%, 85%, 90% and 95%, and the percentage value may also be other numerical values as long as within the foregoing range.

To further improve the using comfort level of the combined carpet, the maximum coincidence area of the upper carpet body and the lower carpet body is ensured during use, and problems of edge warping, displacement and difficult paving occurred to the edge position of the upper carpet body 1 are also avoided. In the present disclosure, the percentage value of the area of the lower carpet body 2 and the area of the upper carpet body 1 ranges from 55% to 90%, and preferably 55% to 80%. In the embodiment of the present disclosure, the specific shapes of the upper carpet body 1 and the lower carpet body 2 are not limited, the projection on the floor may be a rectangle, a round or other shapes as long as the percentage value of the area of the lower carpet body 2 and the area of the upper carpet body 1 is within the foregoing range.

In this embodiment, both the upper carpet body 1 and the lower carpet body 2 adopt rectangular shapes and have long sides, short sides and certain heights, and therefore the upper carpet body 1 and the lower carpet body 2 have lengths, widths and thicknesses. To calculate and cut conveniently during production, a limitation to the lengths and widths of the upper carpet body 1 and the lower carpet body 2 is made in the embodiment of the present disclosure. The length percentage value of the lower carpet body 2 and the upper carpet body 1 is limited within 60%-100%, specifically the length percentage value of the lower carpet body 2 and the upper carpet body 1 may be 60%, 65%, 70%, 75%, 80%, 85%, 90%, 95% and 100%, and the percentage value may also be other numerical values as long as within the foregoing range. To further improve the using comfort level of the combined carpet and achieve a wide application scenario, pave at least part of the long side or wide side of the upper carpet body 1 on the object surface such as the floor to avoid the problems of edge warping, displacement and difficult paving occurred to the edge position of the upper carpet body 1, the length percentage value of the lower carpet body 2 and the upper carpet body 1 ranges from 75% to 95%, and preferably 80% to 95%. At the same time, the width percentage value of the lower carpet body 2 and the upper carpet body 1 is limited between 100% and 55%, the width percentage value of the lower carpet body 2 and the upper carpet body 1 may be 55%, 60%, 65%, 70%, 75%, 80%, 85%, 90%, 95% and 100%, and the percentage value may also be other numerical values as long as within the foregoing range. Preferably, the width percentage value of the lower carpet body 2 and the upper carpet body 1 is between 95% and 60%. Specifically, in the embodiment of the present disclosure, the width percentage value of the lower carpet body 2 and the upper carpet body 1 is between 90% and 60%, which may enable the combined carpet to have a higher comfort level and less problems during use.

Figure 10:
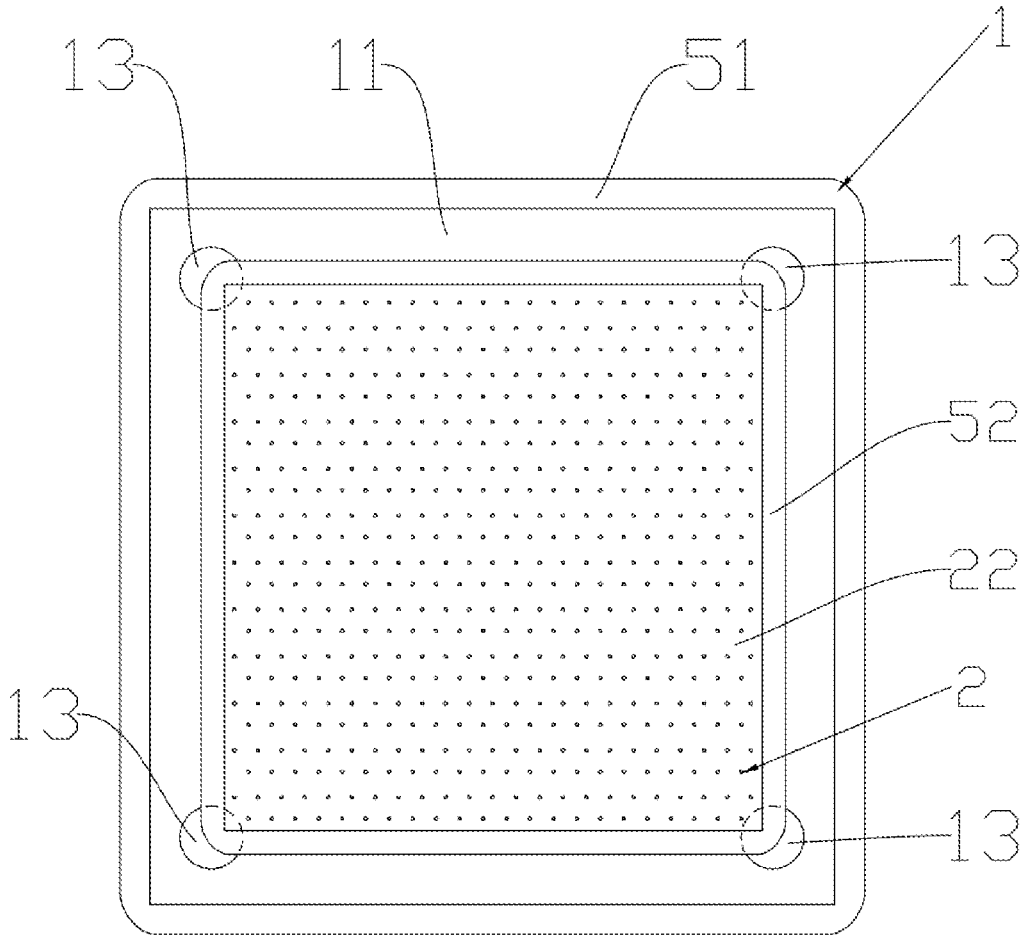
FIG. 10 is a vertical diagram of a combined carpet used in combination of the present disclosure.

Please refer to FIG. 10, in this embodiment, a surface of one side of the first anti-skidding layer 11 that faces to the first flexible fabric layer 21 is also provided with an alignment mark 13, the alignment mark 13 is used for aligning a long side or a short side or a corner of the lower carpet body 2, such that the lower carpet body 2 is located below a preset position of the upper carpet body 1 when the upper carpet body 1 is paved above the lower carpet body 2. In this embodiment, the alignment mark 13 adopts a round pattern, when the combined carpet is paved, the corner of the lower carpet body 2 is aligned with the alignment mark 13, and then the combined carpet is paved on the floor, that is, the lower carpet body 2 may be paved at the preset position of the upper carpet body 1. It may be understood that the preset position is the area limited by the alignment mark 13. The lower carpet body 2 may be aligned with the upper carpet body conveniently 1 during paving by setting the alignment mark 13, such that the combined paving is more convenient.

Figure 11:
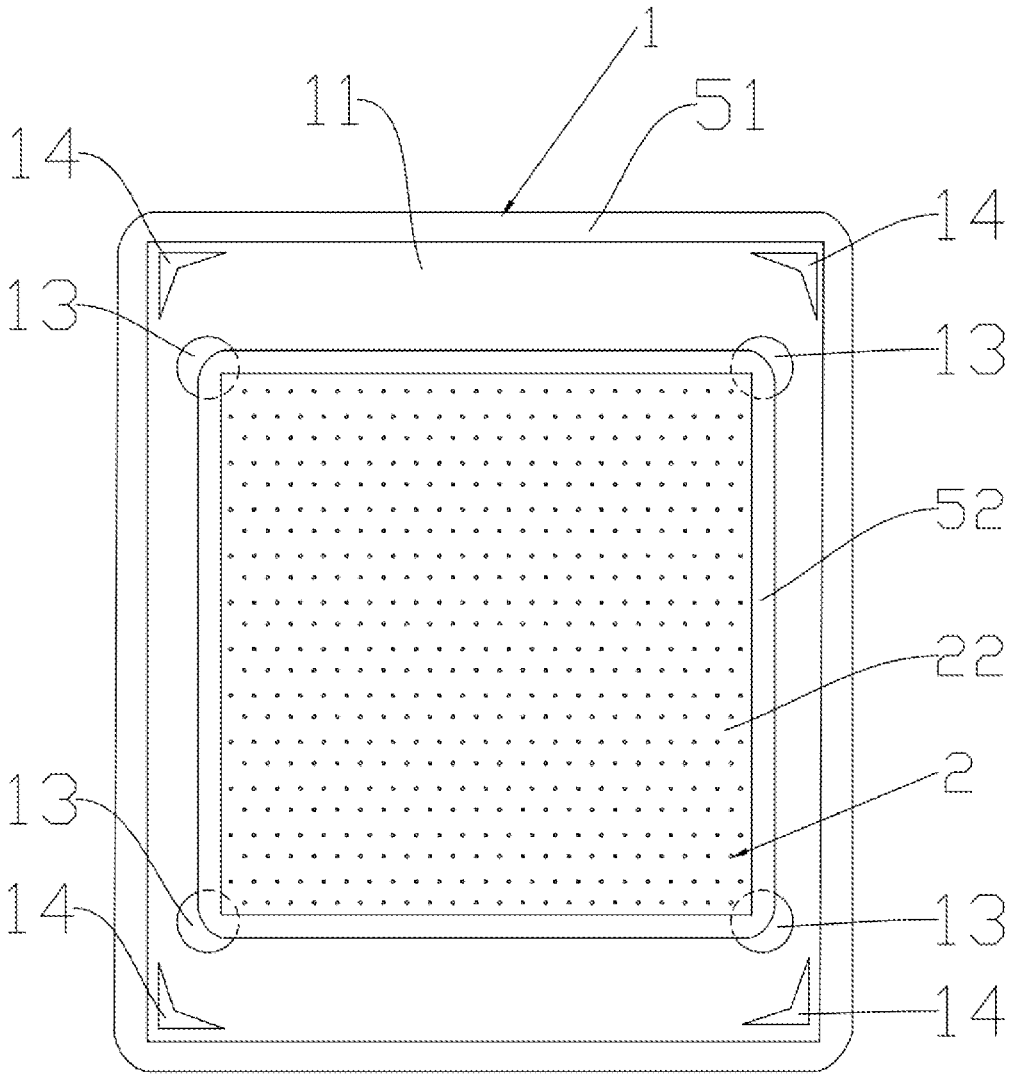
FIG. 11 is a vertical diagram of a combined carpet used in combination in another embodiment of the present disclosure.

Please refer to FIG. 11, in another embodiment, the combined carpet further includes glue 14 that is adhered to four directions of the first anti-skidding layer 11, taking the rectangular shape as an example, the four directions refer to four corners, such that the upper carpet body 1 is adhered to the object surface. The glue 14 may be used separately or directly adhered to the first anti-skidding layer 11, a sticker is removed during use, and a limitation is not made in this application. The upper carpet body 1 can be more stably adhered to the object surface by setting the glue 14, to further ensure the stability that the combined carpet is paved on the object surface when avoiding the relative sliding of the upper carpet body 1 and the lower carpet body 2, to improve the anti-skidding ability.

One or more implementation modes are provided above in combination with specific contents, and it is not deemed that the specific implementation of the present disclosure is limited to these specifications. Any technical deductions or replacements approximate or similar to the method and structure of the present disclosure or made under the concept of the present disclosure shall fall within the scope of protection of the present disclosure.

What is claimed is:

1. A combined carpet, configured to be on an object surface, the combined carpet comprising:

an upper carpet body that comprises a first anti-skidding layer; and a lower carpet body that is arranged between the upper carpet body and the object surface, wherein a surface area of the lower carpet body is less than that of the upper carpet body so as to be completely covered by the upper carpet body, and the lower carpet body comprises a first flexible fabric layer;

wherein the upper carpet body is detachably arranged on the lower carpet body, the first anti-skidding layer contacts the first flexible fabric layer by a static friction force generated between the first anti-skidding layer and the first flexible fabric layer, to prevent movement between the upper carpet body and the lower carpet body;

wherein the first anti-skidding layer has an edge extending beyond the first flexible fabric layer in a manner that the edge of the first anti-skidding layer is staggered from the first flexible fabric layer and not overlapped with the first flexible fabric layer, and the edge of the first anti-skidding layer contacts the object surface, to prevent movement between the combined carpet and the object surface; and wherein the upper carpet body further comprises a first buffer layer and a second flexible fabric layer, the first buffer layer is arranged between the second flexible fabric layer and the first anti-skidding layer, and the first anti-skidding layer comprises a rubber layer and a first fabric layer, and the first fabric layer is adhered to the rubber layer by adopting a hot-pressing technology at a surface of the rubber layer away from the second flexible fabric layer.

2. The combined carpet according to claim 1, wherein a thickness of the upper carpet body is less than or equal to that of the lower carpet body.

3. The combined carpet according to claim 1, wherein the first buffer layer is a needle-punched non-woven fabric, and the second flexible fabric layer comprises a polyester material, and anti-skidding lines are arranged on the rubber layer.

4. The combined carpet according to claim 1, wherein the upper carpet body further comprises a first knitted covered edge that is disposed along a side of the upper carpet body, and edges of the second flexible fabric layer, the first buffer layer and the first anti-skidding layer are covered.

5. The combined carpet according to claim 1, wherein the lower carpet body further comprises a second anti-skidding layer, and the second anti-skidding layer is used for preventing the lower carpet body from skidding relative to the object surface.

6. The combined carpet according to claim 5, wherein the lower carpet body further comprises a second buffer layer that is arranged between the first flexible fabric layer and the second anti-skidding layer.

7. The combined carpet according to claim 6, wherein the second buffer layer is a needle-punched non-woven fabric, the second anti-skidding layer comprises silica gel, and the silica gel is adhered to a surface of the second buffer layer, and the first flexible fabric layer comprises a polyester material.

8. The combined carpet according to claim 6, wherein the second anti-skidding layer comprises a second fabric layer and a hot-melt adhesive layer, the second fabric layer is compounded on one side of the second buffer layer that is away from the first flexible fabric layer, and the hot-melt adhesive layer is located on a surface of one side of the second fabric layer that is away from the second buffer layer.

9. The combined carpet according to claim 8, wherein the second fabric layer comprises a plurality of first woven yarns and a plurality of second woven yarns; and the plurality of first woven yarns and the plurality of second woven yarns are crossly arranged, so as to form the second fabric layer.

10. The combined carpet according to claim 6, wherein the lower carpet body further comprises a second knitted covered edge that is disposed along a side of the lower carpet body, and edges of the first flexible fabric layer, the second buffer layer and the second anti-skidding layer are covered.

11. The combined carpet according to claim 1, wherein the surface area of the lower carpet body is 55% to 80% of the surface area of the upper carpet body, seen from a perspective that the surface area of the upper carpet body is 100%.

12. The combined carpet according to claim 11, wherein both the upper carpet body and the lower carpet body are a rectangular shape and have a length, width and thickness, and a length of the lower carpet body is 75% to 95% of a length of the upper carpet body, seen from a perspective that the length of the upper carpet body is 100%; and a width of the lower carpet body is 90% to 60% of a width of the upper carpet body, seen from a perspective that the width of the upper carpet body is 100%.

13. The combined carpet according to claim 12, wherein a surface of one side of the first anti-skidding layer that faces to the first flexible fabric layer is also provided with an alignment mark, the alignment mark is used for aligning a long side or a short side or a corner of the lower carpet body, such that the lower carpet body is located below a preset position of the upper carpet body when the upper carpet body is arranged above the lower carpet body.

14. The combined carpet according to claim 12, wherein the combined carpet further comprises glue that is adhered to four corners of the first anti-skidding layer, such that the upper carpet body is adhered to the object surface.

15. A combined carpet, comprising:

a multi-layer formed upper carpet body comprising a first anti-skidding layer and at least a second layer formed on the first anti-skidding layer; and a lower carpet body arranged below the upper carpet body, a surface area of the lower carpet body being less than that of the upper carpet body so as to be completely covered by the upper carpet body, with the surface area of the lower carpet body being 55% to 80% of the surface area of the upper carpet body, seen from a perspective that the surface area of the upper carpet body is 100%, and the lower carpet body being multi-layer formed and comprising a first flexible fabric layer and at least a third layer formed under the first flexible fabric layer;

wherein the upper carpet body is detachably arranged on the lower carpet body, the first anti-skidding layer contacts the first flexible fabric layer by a static friction force generated between the first anti-skidding layer and the first flexible fabric layer, to prevent movement between the upper carpet body and the lower carpet body; and wherein the first anti-skidding layer has an edge extending beyond the first flexible fabric layer in a manner that the edge of the first anti-skidding layer is staggered from the first flexible fabric layer and not overlapped with the first flexible fabric layer, and the edge of the first anti-skidding layer contacts an object surface, to prevent movement between the combined carpet and the object surface.

16. The combined carpet according to claim 15, wherein the second layer comprises a first buffer layer and a second flexible fabric layer, the first buffer layer is arranged between the second flexible fabric layer and the first anti-skidding layer; and the third layer comprises a second anti-skidding layer and a second buffer layer, the second buffer layer is arranged between the first flexible fabric layer and the second anti-skidding layer, and the second anti-skidding layer is used for preventing the lower carpet body from skidding relative to the object surface.

17. The combined carpet according to claim 16, wherein each of the first buffer layer and the second flexible fabric layer has an edge extending beyond the first flexible fabric layer in a manner that the edge thereof is staggered from the first flexible fabric layer and not overlapped with the first flexible fabric layer.

* * * * *